US006050003A

United States Patent [19]

Chu

[11] Patent Number: 6,050,003

[45] Date of Patent: Apr. 18, 2000

[54] BOOT WITH OUTSIDE PREFORMED STRESS RELIEF

[76] Inventor: Young Chu, 9245 Santa Fe Springs Rd., Santa Fe Springs, Calif. 90670

[21] Appl. No.: 08/911,317

[22] Filed: Aug. 19, 1997

[51] Int. Cl.[7] ..... A43B 5/00

[52] U.S. Cl. ..... 36/88; 36/93; 36/117.1

[58] Field of Search ..... 36/3 A, 88, 89, 36/109, 93, 95, 115, 117.1, 118.2, 119.1

[56] References Cited

U.S. PATENT DOCUMENTS

| | | | |
|---|---|---|---|
| D. 270,205 | 8/1983 | Casetta . | |
| D. 306,931 | 4/1990 | Itzkowitz . | |
| 1,581,783 | 4/1926 | Bullock | 36/89 |
| 3,303,584 | 2/1967 | Werner et al. | 36/118.2 |
| 3,678,603 | 7/1972 | Kaufman et al. . | |
| 3,728,804 | 4/1973 | Mochizuki | 36/118.2 |
| 3,777,324 | 12/1973 | Jenkins . | |
| 3,957,280 | 5/1976 | Turnheim et al. . | |
| 4,213,256 | 7/1980 | Mas et al. . | |
| 4,271,609 | 6/1981 | Merrifield . | |
| 4,391,049 | 7/1983 | Parisotto | 36/54 |
| 4,724,627 | 2/1988 | Sisco . | |
| 4,920,666 | 5/1990 | Marega | 36/54 |
| 4,995,173 | 2/1991 | Spier . | |
| 4,999,932 | 3/1991 | Grim . | |
| 5,014,450 | 5/1991 | McGrath . | |
| 5,177,884 | 1/1993 | Rullier | 36/118.2 |
| 5,331,752 | 7/1994 | Johnson et al. | 36/115 |
| 5,353,525 | 10/1994 | Grim . | |
| 5,401,041 | 3/1995 | Jespersen | 280/14.2 |
| 5,435,080 | 7/1995 | Meiselman . | |
| 5,634,648 | 6/1997 | Tonel et al. | 36/115 |
| 5,647,150 | 7/1997 | Romanato et al. | 36/117.1 |
| 5,727,337 | 3/1998 | Okajima | 36/50.1 |

FOREIGN PATENT DOCUMENTS

| | | |
|---|---|---|
| 774217 | 5/1997 | European Pat. Off. . |

*Primary Examiner*—M. D. Patterson
*Attorney, Agent, or Firm*—John K. Park; Park & Sutton LLP

[57] ABSTRACT

A boot comprising: (a) a sole; and (b) a shell attached to the sole, the shell having: (i) a lower portion secured to the sole for enclosing a user's foot below the lower ankle, (ii) an upper portion extending upwardly from the lower portion for enclosing at least the user's ankle, and for providing lateral and medial flexing of the user's ankle, and (iii) a groove in a front outer segment of the upper portion of the shell to reduce pressure from the shell on substantially the tibialis anterior muscle when the muscle flexes. Another embodiment of the boot comprises: (a) a sole; and (b) a shell attached to the sole, the shell having: (i) a lower portion secured to the sole for enclosing a user's foot and at least the front portion of the user's ankle, (ii) an upper portion extending upwardly from the lower portion for providing lateral and medial flexing of the user's ankle, and (iii) a groove in a front outer segment of the lower portion of the shell to reduce pressure from the shell on substantially the tibialis anterior muscle when the muscle flexes.

2 Claims, 3 Drawing Sheets

BOOT WITH OUTSIDE PREFORMED STRESS RELIEF

BACKGROUND

The present invention generally relates to footwear and in particular to boots.

Boots are utilized for a variety of functions including sports, work, and everyday wear. A typical boot has a shell which encloses the user's foot around the ankle area. Further, the shell can enclose the user's shin and calf. The ankle can flex laterally and medially depending on the user's movements. The ankle joint is supported by muscles interconnected between the foot and the shin area of a user's leg. Depending on the user's movement and resulting flexing of the ankle, corresponding muscles groups flex to support the user's wait and provide balance. For example, when the user leans or bends forward the tibialis anterior and proximate muscles flex and protrude forward from the ankle area.

A major disadvantage of existing boots is that the shell stresses the flexing muscles by blocking their protrusion. This is because the user's ankle is enclosed in the shell and the shell presses against the protruding muscle. This is particularly disadvantageous when the boot is a sport or work boot where the user frequently bends or leans forward. Stress on said muscles can lead to discomfort and injury.

There is, therefore, a need for a boot which reduces pressure on the tibialis anterior and proximate muscles when the user moves or leans forward.

SUMMARY

The present invention satisfies this need. The present invention provides a boot comprising: (a) a sole; and (b) a shell attached to the sole, the shell having: (i) a lower portion secured to the sole for enclosing a user's foot below the lower ankle, (ii) an upper portion extending upwardly from the lower portion for enclosing at least the user's ankle, and for providing lateral and medial flexing of the user's ankle, and (iii) a groove in a front outer segment of the upper portion of the shell to reduce pressure from the shell on substantially the tibialis anterior muscle when the muscle flexes. Typically, the tibialis anterior muscle and proximate muscles, such as Exterior Hallucis Longus, flex when the user bends or leans forward.

The groove is shaped, sized and positioned on said outer segment to allow said outer segment to yield to at least a portion of the protruding tibialis anterior muscle when the muscle flexes. The upper portion of the shell can enclose at least a portion of the calf and the shin of the user's leg. The sole can be of a rigid material and the shell of a resilient material. The shell can also be a one piece resilient material. Alternatively, the boot can further comprise pivot means attached to the upper portion and to the lower portion of the shell to allow medial movement of the user's ankle.

In another aspect the present invention provides a boot comprising: (a) a sole; and (b) a shell attached to the sole, the shell having: (i) a lower portion secured to the sole for enclosing a user's foot and at least the front portion of the user's ankle, (ii) an upper portion extending upwardly from the lower portion for providing lateral and medial flexing of the user's ankle, and (iii) a groove in a front outer segment of the lower portion of the shell to reduce pressure from the shell on substantially the tibialis anterior muscle when the muscle flexes.

The upper portion of the shell can enclose at least a portion of the calf and the shin of the user's leg. The sole can be rigid and the shell can be resilient. The shell can be a one piece resilient material. The groove is shaped, sized and positioned on said outer segment to allow said outer segment to yield to at least a portion of the protruding muscle when the muscle flexes. The boot can also include pivot means attached to the upper portion and to the lower portion of the shell to allow medial movement of the user's ankle.

A boot according to the present invention overcomes the disadvantage of existing boots by providing an outer stress relief in the form of said groove to allow the shell to yield to at least a portion of the protruding anterior muscle and proximate muscles when said muscles flex. As such, the user can wear such a boot for a variety of functions including sports, work and every day use, without stress on the user's foot.

DRAWINGS

These and other features, aspects, and advantages of the present invention will become better understood with regard to the following description, appended claims, and accompanying drawings which illustrate examples of the invention, where:

DESCRIPTION

Figure 1:
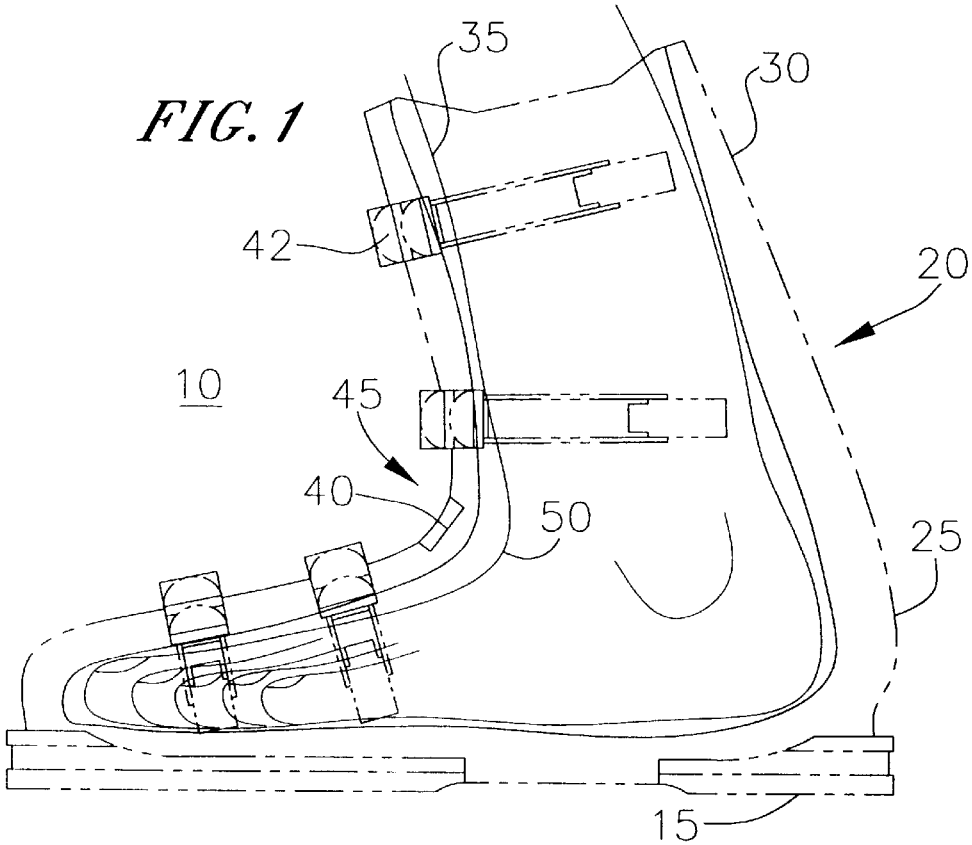
FIG. 1 is a side section view of an embodiment of a boot according to the present invention.
Figure 2:
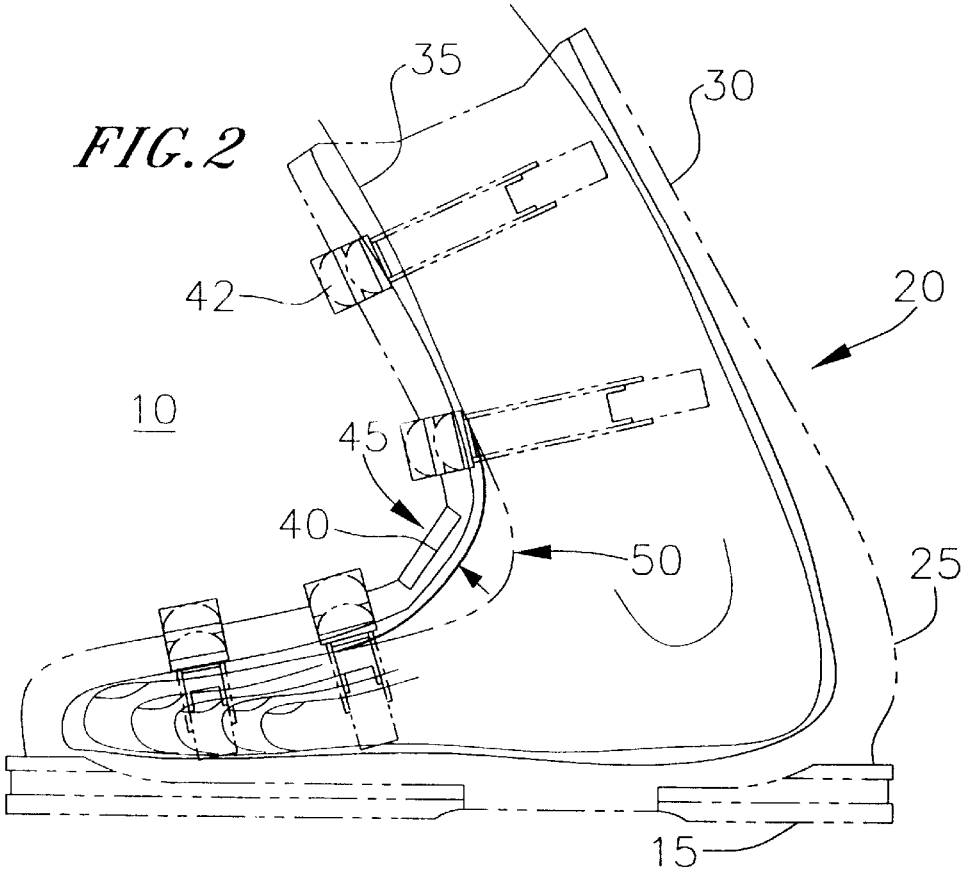
FIG. 2 is a side section view of the boot of FIG. 1, with the user leaning forward.

Referring to FIG. 1, a boot 10 according to the present invention is shown. The boot 10 comprises: (a) a sole 15; and (b) a shell 20 attached to the sole 15, the shell 20 having: (i) a lower portion 25 secured to the sole 15 for enclosing a user's foot 35 below the lower ankle, (ii) an upper portion 30 extending upwardly from the lower portion 25 for enclosing at least the user's ankle, and for providing lateral and medial flexing of the user's ankle, and (iii) a groove 40 in a front outer segment 45 of the upper portion 30 of the shell 20 to reduce pressure from the shell 20 on substantially the tibialis anterior muscle 50 when the muscle flexes. The groove 40 can also be positioned in a front outer segment 45 of the lower portion 25 of the shell 20 to reduce pressure from the shell 20 on substantially the tibialis anterior muscle 50 when the muscle flexes 50 as shown in FIG. 2. In FIG. 2, the arrow shows flexing of the tibialis anterior muscle 50 from a relaxed position indicated by broken lines to a flexing position indicated by dotted lines.

Figure 3:
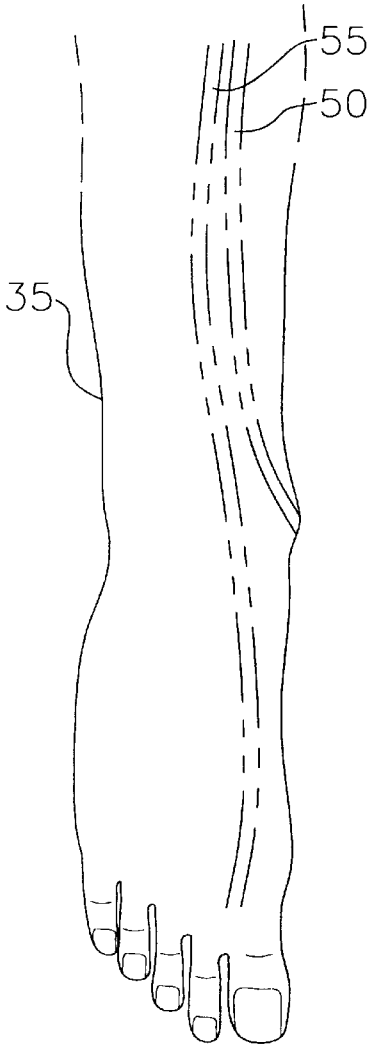
FIG. 3 is a side view of a human foot showing the tibialis anterior muscle.
Figure 4:
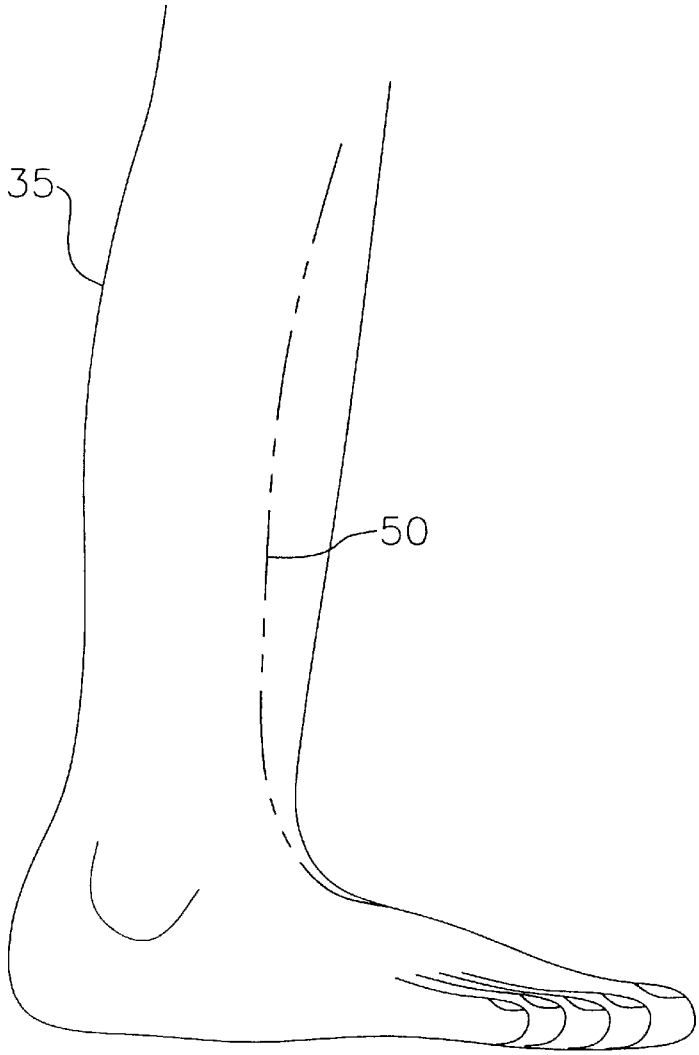
FIG. 4 is a front view of a human foot showing the tibialis anterior muscle and Exterior Hallucis Longus muscle.

Referring to FIGS. 3 and 4, typically, the tibialis anterior muscle 50 and proximate muscles, such as Exterior Hallucis Longus 55, flex when the user bends or leans forward. The groove 40 provides stress relief by reducing pressure from the shell 20 on substantially the tibialis anterior muscle 50 and proximate muscles flex. As such, the user can wear such a boot for a variety of functions including sports, work and every day use, without stress on the user's foot 35.

Figure 5:
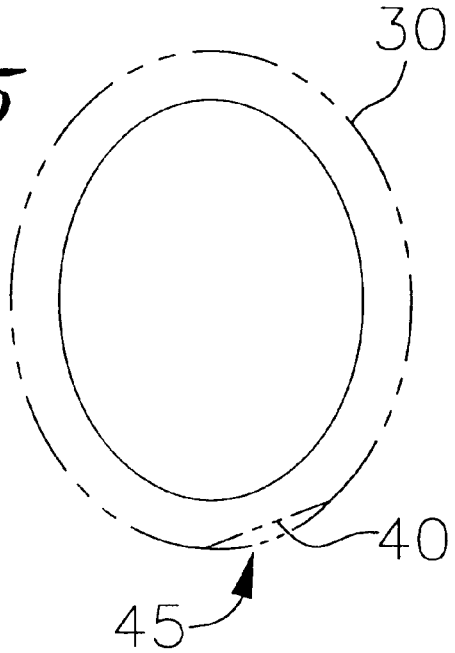
FIG. 5 is a front section view of the boot of FIG. 1.
Figure 6:
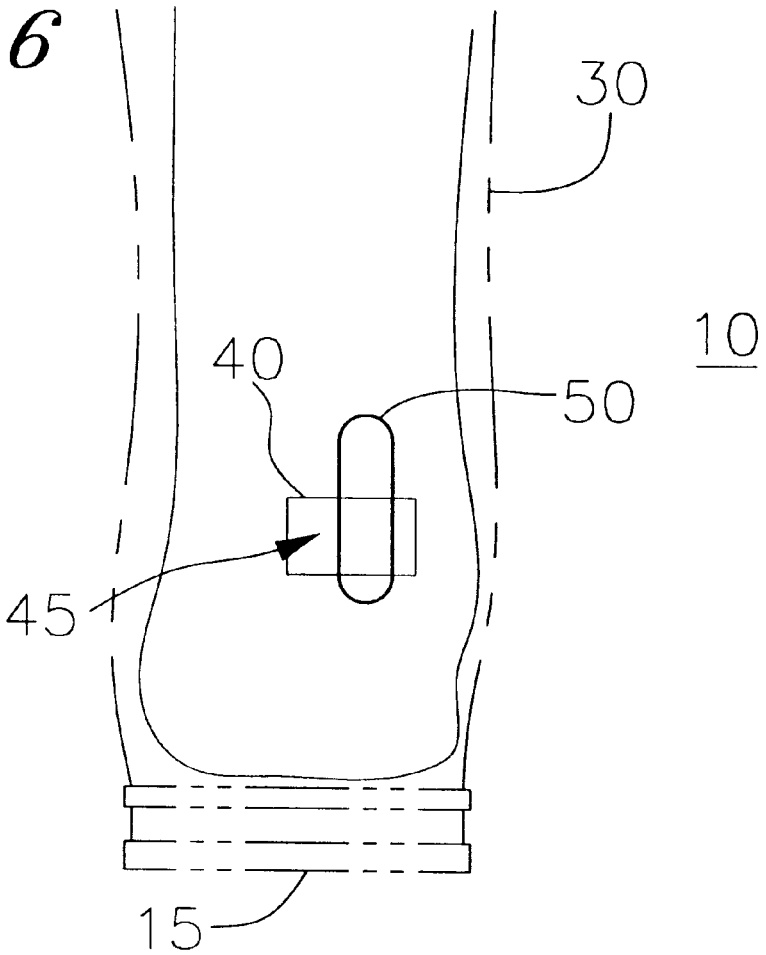
FIG. 6 is a top section view of the portion of the boot of FIG. 1 including the groove for stress relief.

Referring to FIGS. 5 and 6, the groove 40 is positioned on the outer segment 45 to allow at least a portion of the outer segment 45 to yield to at least a portion of the protruding muscle 50 when the muscle 50 flexes. As such, the location of the groove 40 on the outer segment 45 can be selected based on human anatomy and the activities the boot 10 is designed for so that the groove 40 can allow the shell to yield to the flexing muscle 50. Similarly, the shape and the size of the groove 40 can be selected to accommodate flexing of the shell when the tibialis anterior muscle 50 flexes depending on the type of activities the boot 10 is designed for. The groove can be a cut-away indentation on the segment 45 to reduce pressure applied to the Tibialis Anterior muscle 50 by the shell 20. The indentation makes the shell more flexible around the area where the muscle 50 comes into contact with the shell 20. This allows the shell 20 to yield to the protruding muscle 50, thereby reducing pressure on the protruding muscle 50.

For example, in case of a ski boot, the groove 40 can be substantially rectangular in shape, having a width of about 0.2 inches to about 2.0 inches, and preferably about 0.7 inches to about 1.2 inches. In that case, the groove 40 can have a length of about 0.5 inches to about 2.0 inches, and preferably about 1.0 inches to about 1.3 inches. The groove 40 can have a depth of about 0.1 inches to about 0.4 inches, and preferably about 0.1 inches to about 0.2 inches. These dimensions are given as a general guidance, and should not limit the size of the groove 40 as the width, length, and depth of the groove 40 may be lesser or longer than the dimensions specified above. Moreover, the groove 40 can be selected to be of other shapes, including substantially elliptical and substantially square.

The ski boot can have straps 42 for securing the boot 10 to the user's foot 35. At least one of the straps 42 externally presses against the front outer segment 45 when the strap 42 is fastened. The inventor believes that the groove 40 and the front outer segment 45 are most effectively used in boot designs which have a strap 42 directly over the groove 40 across the front outer segment 45 over the outer surface of the shell 20.

The groove 40 provides a clearance between the strap 42 and the shell 20, reducing pressure from the strap 42 against the shell 20 over the front outer segment 45 and over the groove 40, thus reducing the pressure on the tibialis anterior muscle 50. Moreover, for the better performance, the width of the groove should be slightly wider than the width of the straps 42. As such, the boot 10 of the present invention provides stress relief for the user's foot 35.

The groove 40 is advantageous for all footwear covering tibialis anterior muscle 50 and proximate muscles, such as Exterior Hallucis Longus 55. In case of boots having a resilient shell wherein the shell 20 does not bend easily, such as in case of ski boots, the user's foot 35 must substantially conform to the shape of the shell 20 when the user moves. With the groove 40 in the outer portion of the shell 20 according to the present invention, the user can easily engage in activities which flex the tibialis anterior muscle 50 and proximate muscles with the groove 40 providing stress relief as described above. This is advantageous in protecting the user's foot 35 from fatigue and undue stress due to pressure from the shell 20, and at the same time allow the shell 20 to be constructed from a material and of a shape most suitable for specific or general activity.

The upper portion 30 of the shell 20 can extend upwardly to enclose at least a portion of the calf and the shin of the user's leg. For example, the upper portion 30 of a ski boot according to the present invention can extend upward to about mid-way between the knee and the ankle of the user, thereby covering a portion of the calf and the shin of the user's leg.

The material for the shell 20 can be selected for specific activities, or for general wear. The shell 20 can be of a resilient or pliable material. For example, in case of a ski boot, the shell 20 can be made from a resilient material such as plastic. The shell 20 can also be made from light-weight material such as nylon or other polymeric material. The inner portion of the shell 20 can be padded. The padding material can be foam or other soft material used for comfort and cushioning effect. The padding can be fabricated from an elastic material such as Styrofoam into a one piece cushion of a desired shape and size based on the shape and size of the shell 20.

The shell 20 can be of a one piece material, or a plurality of pieces attached together by, for example, stitching or gluing. Depending on the function of the boot 10, the shell material and attachment of the upper and lower portions 30, 25 of the shell 20 can be selected to allow lateral and medial movement of the user's ankle.

For example, at least a segment of the upper and the lower portions 30, 25 of the boot 10 can be attached to one another, leaving free segments, to allow flexing of the shell 20 for medial and lateral movement of the user's ankle. As another example, the upper portion 30 and the lower portion 25 of the shell 20 can be attached to one another via pivot means to allow medial and/or lateral movement of the user's ankle. The pivot means can be at least one rigid pin disposed in corresponding holes in the upper and lower portions 30, 25 of the shell 20, allowing pivoting of the upper and lower portions 30, 25 of the shell 20 relative to one another.

The material for the sole 15 can be selected for specific activities, or for general wear. The sole 15 can be of a rigid or resilient material. The sole 15 can also include any desired pattern for ample friction against ground in dry or wet conditions. For example, in case of a ski boot, the sole 15 can be made from plastic or other light weight and resilient material such as polymeric materials. The portion of the sole 15 coming in contact with the user's foot 35 can be padded for comfort and protection. The padding material can be foam or other soft material used for comfort and cushioning effect. The padding can be fabricated from an elastic material such as Styrofoam into a one piece cushion of a desired shape and size based on the shape and size of the sole 15.

Although ski boots have been described herein as example embodiments of a boot 10 according to the present invention, the present invention applies to all footwear covering the tibialis anterior muscle 50 and proximate muscles. For example, a boot 10 according to the present invention applied to sport boots, work boots and boots for everyday wear. The placement, shape and size of the groove 40 in each case is as described herein.

Although the present invention has been described in considerable detail with regard to the preferred versions thereof, other versions are possible. Therefore, the appended claims should not be limited to the descriptions of the preferred versions contained herein.

What is claimed is:

1. A boot comprising:

(a) a sole; and (b) a shell attached to the sole, the shell having:

(i) a lower portion secured to the sole for enclosing a user's foot below the lower ankle, (ii) an upper portion extending upwardly from the lower portion for enclosing at least the user's ankle, and for providing lateral and medial flexing of the user's ankle, and (iii) a groove in a front outer segment of the upper portion of the shell to reduce pressure from the shell on substantially the tibialis anterior muscle when the muscle flexes; and (c) at least one strap originating from a first side of the shell, extending over at least a portion of said front segment of the lower portion of the shell, and terminating at a second side of the shell substantially opposite said first side, wherein the groove is positioned on said front segment of the upper portion substantially under said strap.

2. A boot comprising:

(a) a sole; and (b) a shell attached to the sole, the shell having:

(i) a lower portion secured to the sole for enclosing a user's foot and at least the front portion of the user's ankle, (ii) an upper portion extending upwardly from the lower portion for providing lateral and medial flexing of the user's ankle, and (iv) a groove in a front outer segment of the lower portion of the shell to reduce pressure from the shell on substantially the tibialis anterior muscle when the muscle flexes; and (c) at least one strap originating from a first side of the shell, extending over at least a portion of said front segment of the lower portion of the shell, and terminating at a second side of the shell substantially opposite said first side, wherein the groove is positioned on said front segment of the lower portion substantially under said strap.

* * * * *